United States Patent [19]

Jensen

[11] 4,039,430

[45] Aug. 2, 1977

[54] OPTIMUM LIQUID MASS FLUX FOR TWO PHASE FLOW THROUGH A FIXED BED OF CATALYST

[75] Inventor: Robert H. Jensen, Clarendon Hills, Ill.

[73] Assignee: UOP Inc., Des Plaines, Ill.

[21] Appl. No.: 644,990

[22] Filed: Dec. 29, 1975

[51] Int. Cl.[2] ..... C10G 13/02; C10G 23/02

[52] U.S. Cl. ..... 208/108; 208/134; 208/143; 208/146; 208/213; 208/264

[58] Field of Search ..... 208/108-112, 208/143, 146, 134, 213, 264

[56] References Cited

U.S. PATENT DOCUMENTS

| | | | |
|---|---|---|---|
| 2,603,591 | 7/1952 | Evans | 208/146 |
| 3,390,073 | 6/1968 | Godar et al. | 208/48 |
| 3,498,908 | 3/1970 | Frankovich | 208/112 |
| 3,524,731 | 8/1970 | Effron et al. | 23/288 |
| 3,554,897 | 1/1971 | Stanley | 208/48 |
| 3,556,737 | 1/1971 | Boyd | 23/288 |
| 3,776,835 | 12/1973 | Dvoracek | 208/48 |
| 3,844,936 | 10/1974 | Newson | 208/108 |
| 3,898,049 | 8/1975 | Burroughs et al. | 23/288 |
| 3,902,856 | 9/1975 | Burroughs et al. | 23/288 |

*Primary Examiner*—Delbert E. Gantz
*Assistant Examiner*—G. E. Schmitkons
*Attorney, Agent, or Firm*—James R. Hoatson, Jr.; Thomas K. McBride; William H. Page, II

[57] ABSTRACT

A process for the maximum utilization of a fixed bed of spherical catalyst by approaching perfect liquid distribution in the bed by means of selecting a liquid mass flux in the range of about 2000 to about 4000 lb/hr-ft$^2$.

3 Claims, 2 Drawing Figures

Figure 1
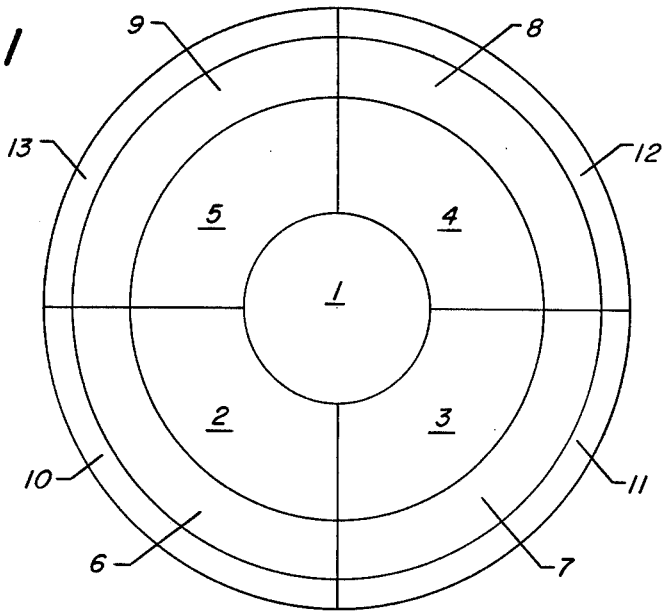
Plan View Of Collection Zones
Approach To Plug Flow Versus Liquid Mass Flux For A Spherical Catalyst System
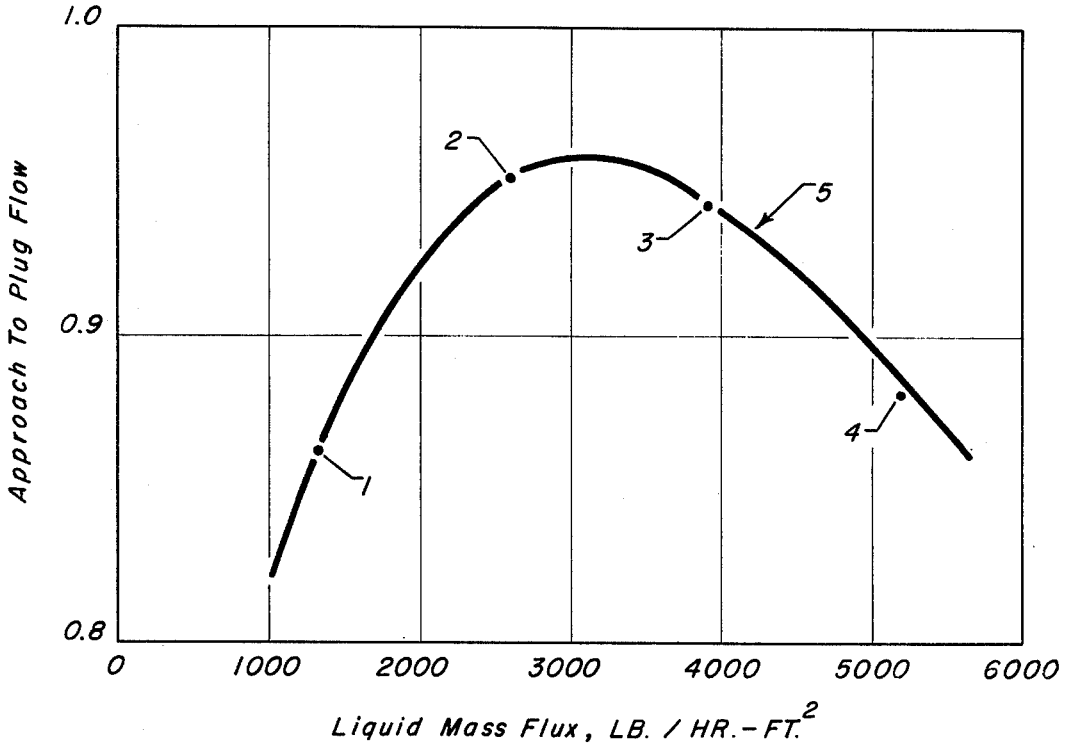
Figure 2

OPTIMUM LIQUID MASS FLUX FOR TWO PHASE FLOW THROUGH A FIXED BED OF CATALYST

This invention relates to a process for the maximum utilization of a fixed bed of spherical catalyst by approaching perfect liquid distribution in the bed by means of selecting a liquid mass flux in the range of about 2000 to about 4000 lb/hr-ft$^2$.

Chemical reactions are frequently performed with a reactor or catalyst bed filled with a catalyst material. By way of example, liquids can be flowed through a bed of catalyst material to react, with the resulting product drawn off. Optimal operation of such a reactor requires that the catalyst material be spread substantially uniformly across the reaction zone in order to obtain a homogeneous loading of particulate catalyst together with the particulates' concomitant void space. The prior art has fully explored various techniques to obtain a substantially homogeneous catalyst bed. It is not my purpose to further contribute to the above-mentioned catalyst loading art, but to demonstrate a method which fully exploits the use of an existing homogeneous catalyst bed.

The efficiency of the chemical reaction is dependent on the degree of uniformity of the liquid flow profile as it passes down through the catalyst bed. Perfect liquid distribution, or "plug flow", will result in the most efficient utilization of the catalyst.

An object of the present invention is to afford a process for the maximum utilization of a fixed bed of spherical catalyst by approaching perfect liquid distribution in the bed by means of selecting an optimum liquid mass flux.

A specific object of my invention resides in a catalytic process for processing hydrocarbons with hydrogen and spherical catalyst at a temperature of from about 200° F to about 900° F, a pressure of from about 75 to about 5000 psig., a liquid hourly space velocity of from about 0.1 to about 30 and a hydrogen circulation rate of from about 100 to about 10,000 s.c.f./bbl. wherein the liquid mass flux is from about 2000 to about 4000 lb/hr-ft$^2$.

In the design of a chemical reactor which will contain a fixed bed of catalyst, the liquid and gas feed rates and the reaction zone volume are normally fixed. The designer then must specify the diameter and length of the reaction vessel. The following dimensions then specify the liquid and gas mass fluxes:

$$L = (4\,M_L/\pi D^2)$$

$$G = (4\,M_G/\pi D^2)$$

where

L = liquid mass flux, lb/hr-ft$^2$
G = gas mass flux, lb/hr-ft$^2$
$M_L$ = liquid feed rate, lb/hr
$M_G$ = gas feed rate, lb/hr
D = reactor diameter, ft In order to demonstrate the advantages of the present invention, I have selected iso-octane and nitrogen as fluids for a demonstration. These fluids when transported at 70° to 100° F. very closely resemble the characteristics of reduced crude oil and hydrogen rich gas at temperatures in the range of 650° to 750° F. as demonstrated in Table I.

TABLE I

Simulated Characteristics Of Reduced Crude Oil And Hydrogen At Reaction Conditions

| Fluid | Reduced Crude | Iso-Octane | Hydrogen Rich Gas | Nitrogen |
|---|---|---|---|---|
| Temperature, ° F. | 740 | 70 | 740 | 70 |
| Pressure, psig. | 2,000 | 200 | 2,000 | 200 |
| Density, lb/ft$^3$ | 39.3 | 43.4 | 1.0 | 1.0 |
| Viscosity, cp. | 0.5 | 0.5 | 0.018 | 0.018 |
| Surface Tension, dynes/cm. | >10 | 21.8 | — | — |

These and other aspects of the present invention are more apparent in the following detailed description and claims, particularly when considered in conjunction with the accompanying drawings.

FIG. 1 is a plan view of the liquid collection zones.

FIG. 2 is presented for the purpose of visually demonstrating the advantages afforded by the instant invention by comparing approach to plug flow with liquid mass flux.

The advantages of the present invention are more apparent if the effluent distribution from a catalyst bed operated at several different liquid mass flux densities is recorded and analyzed. With reference now to FIG. 1, liquid collection zones, 1 through 13, were positioned below the catalyst bed to collect liquid effluent from each selected area. The diameter of the group of liquid collection zones coincided exactly with the diameter of the catalyst bed.

The following Table II indicates the sum of the area of various liquid collection zones with respect to the total area of all such zones.

TABLE II

| Zone or Zones | Area, Percent |
|---|---|
| 1 | 9.35 |
| 2, 3, 4, 5 | 40.96 |
| 6, 7, 8, 9 | 39.92 |
| 10, 11, 12, 13 | 9.77 |

It is now my intention to define a description of an approach to plug flow or APF as:

$$APF = 1.0 - \frac{\sum_{L=1}^{13} \frac{A_i}{A_T} |L_i - 1|}{1.95}$$

wherein $A_i$ = Area of a liquid collection zone
$A_T$ = Total area of all liquid collection zones
$L_i$ = Dimensionless liquid velocity for sub zone $i$ In order to demonstrate the usefulness of the APF equation, let us assume one of the worst possible cases of liquid distribution and that 100% of the liquid flow is through liquid collection zone 13, or approximately 2.5% of the catalyst zone cross-section. In this case:

$$L_1, L_2, \ldots L_{12} = 0$$

$$L_{13} = (100/2.5) = 40$$

Then $$APF = 1.0 - \frac{(0.975)\,(1) + (0.025)\,(39)}{1.95}$$

$$APF = 1.0 - \frac{1.95}{1.95}$$

$$APF = 0$$

Now let us consider the best possible case where there is even distribution of liquid and $$L_1, L_2 \ldots L_{13} = 1.0$$

Then $$APF = 1.0$$

The following Table III further demonstrates the relationship between liquid distribution within a catalyst bed and the APF or approach to plug flow.

TABLE III

| Liquid Flow Area, % Of Cross-Section | APF |
|---|---|
| 2.5 | 0 |
| 10.0 | 0.0725 |
| 50.0 | 0.6125 |
| 90.0 | 0.8975 |
| 100.0 | 1.0 |

The following example is presented for the purpose of illustrating the beneficial effects of the process of the present invention. It is understood that the present invention is not intended to be limited beyond the scope and spirit of the appended claims or by the catalyst and reaction zone configuration as utilized in the example.

EXAMPLE

A fixed catalyst bed was prepared by loading 0.057 inch diameter alumina catalyst spheres into a vessel which was 2 feet in diameter and 6 feet in length. A group of thirteen collection zones as described hereinabove was placed directly beneath the catalyst bed in order to collect the downwardly flowing liquid after it had passed through the catalyst. A mixture of isooctane and nitrogen was passed through the hereinabove described bed at a pressure of 200 psig. with a gas mass flux of 1200 lb/hr-ft$^2$ and a liquid mass flux of 1375 lb/hr-ft$^2$ which produced an APF (approach to plug flow) of 0.86. Another run was made which was identical to the previous run except that the liquid mass flux was increased to 2,575 lb/hr-ft$^2$ which produced an APF of 0.95. Another run was made with the liquid mass flux increased to 3,875 lb/hr-ft$^2$ which produced an APF of 0.94. Yet another run was made with the liquid mass flux increased to 5,125 lb/hr-ft$^2$ which produced an APF of 0.88. The hereinabove described correlation between liquid mass flux rate and the approach of plug flow are presented in tabular form in the following Table IV and in graphical form in FIG. 2.

TABLE IV

| Run | Liquid Mass Flux | APF |
|---|---|---|
| 1 | 1,375 | 0.86 |
| 2 | 2,575 | 0.95 |
| 3 | 3,875 | 0.94 |
| 4 | 5,125 | 0.88 |

From the data presented in foregoing Table IV and with reference to FIG. 2, it will be seen that the best liquid distribution, or the greatest approach to plug flow (APF), occurs when the liquid mass flux is from about 2000 to about 4000 lb/hr-ft$^2$. Datum points 1, 2, 3 and 4 in FIG. 2 are representative of the results obtained from Runs 1, 2, 3, and 4, respectively. These data were employed in preparing curve 5 of FIG. 2, which curve clearly illustrates the benefits of the instant invention and the critically attached to a liquid mass flux from about 2000 to about 4000 lb/hr-ft$^2$. The additional economic advantages afforded through this particular result will be readily recognized by those possessing skill within the art.

The foregoing specification and example clearly illustrate the improvements encompassed by the present invention and the benefits to be afforded a process which has improved liquid flow distribution characteristics.

I claim as my invention:

1. A catalytic process for processing a fluid stream composed of liquid and gas by contacting said liquid and gas at a uniform rate of flow with a bed of fixed spherical catalyst, said contacting producing a chemical interaction of said liquid and gas, the improvement which comprises approaching perfect liquid distribution in said bed by means of selecting a liquid mass flux in the range of about 2000 to about 4000 lb/hr-ft$^2$.

2. The process of claim 1 further characterized in that said liquid and gaseous hydrogen.

3. A catalytic process for uniformly processing liquid hydrocarbons with gaseous hydrogen and spherical catalyst at a temperature of from about 200° F. to about 900° F., a pressure of from about 75 to about 5000 psig., a liquid hourly space velocity of from about 0.1 to about 30 and a hydrogen circulation rate of from about 100 to about 10,000 s.c.f./bbl. wherein the liquid mass flux is from about 2000 to about 4000 lb/hr-ft$^2$.

* * * * *